United States Patent [19]

Park

[11] Patent Number: 4,939,809

[45] Date of Patent: Jul. 10, 1990

[54] TANK TYPE LIQUID VACUUM CLEANER

[76] Inventor: Chul Park, 1837 Green Place Ter., Rockville, Md. 20850

[21] Appl. No.: 345,574

[22] Filed: May 1, 1989

[51] Int. Cl.[5] ..... A47L 5/36

[52] U.S. Cl. ..... 15/328; 15/339; 15/353; 15/412; 55/256

[58] Field of Search ..... 15/353, 328, 339, 412; 55/256

[56] References Cited

U.S. PATENT DOCUMENTS

| | | | |
|---|---|---|---|
| 1,817,265 | 5/1930 | Pando . | |
| 2,208,673 | 3/1939 | Hopkins . | |
| 3,579,706 | 5/1971 | Hetland | 15/412 X |
| 3,605,786 | 9/1971 | Machin | 15/353 X |
| 3,695,006 | 10/1972 | Valbona et al. | 15/412 X |
| 3,745,745 | 7/1973 | Mare | 55/95 |
| 3,930,281 | 1/1976 | Principe et al. | 15/320 |
| 4,005,999 | 2/1977 | Carlson | 55/93 |
| 4,179,768 | 12/1979 | Sawyer | 15/352 |
| 4,287,635 | 9/1981 | Jacobs | 15/353 X |
| 4,487,746 | 12/1984 | Tahiliani | 422/170 |
| 4,585,599 | 4/1986 | Czarno | 261/2 |
| 4,776,060 | 10/1988 | Chang | 15/353 X |

*Primary Examiner*—Chris K. Moore

*Attorney, Agent, or Firm*—Birch, Stewart, Kolasch & Birch

[57] ABSTRACT

A tank type liquid vacuum cleaner includes, an intake hose, a L-shaped air inlet tube, a liquid tank, an anti-overflow cylinder in the liquid tank, a ball valve in a ball valve containing tube disposed within the anti-overflow cylinder, an air outlet, a suction fan, and a three-stage switch, whereby the vacuum cleaner effectively cleans up dust, debris, dirty air, and the like, can be easily disassembled for cleaning the internal surface of the liquid tank, and can be readily converted to an air cleaner when the intake hose is removed therefrom. Further, the cleaner is constructed so that the liquid in the liquid tank is prevented from spilling when the vacuum cleaner accidentally falls over on the floor.

7 Claims, 3 Drawing Sheets

TANK TYPE LIQUID VACUUM CLEANER

BACKGROUND OF THE INVENTION

1. Field of the Invention

The present invention relates to a tank type liquid vacuum cleaner which scrubs dirt and debris as well as dirty air over the surface of a liquid such as water and more particularly, to an improved tank type liquid vacuum cleaner including an intake hose, a L-shaped inlet tube, a liquid tank, a ball valve, a vent opening, a suction fan, and a suction fan controlling switch for readily and effectively cleaning dirt, debris, dirty air, or the like, and for preventing the liquid from spilling when the cleaner falls over on the floor. Also the tank type liquid vacuum cleaner is usable as an air cleaner upon separating the intake hose therefrom.

2. Description of the Prior Art

Various types of air or vacuum cleaners which operate on the principle of passing dust, debris, or dirty air over the surface of a liquid are known in the art. However, such cleaners suffer from various disadvantages. It is very difficult to effectively clean the dust, debris, and dirty air in the liquid tank since these dirty materials are not readily soluble in the liquid and, it is also a difficult task to completely clean the liquid tank therein and to assemble and disassemble the cleaner since the cleaner has a complicated structure. Furthermore, when such a cleaner falls over on the floor, the liquid in the liquid tank spills therefrom. Further still, the vacuum cleaner cannot be converted for use as an air cleaner. Such conventional vacuum or air cleaners are shown in Pando U.S. Pat. No. 1,817,265, Hopkins U.S. Pat. No. 2,208,673, Mare U.S. Pat. No. 3,745,745, Principe et al U.S. Pat. No. 3,930,281, Carlson U.S. Pat. No. 4,005,999, Sawyer U.S. Pat. No. 4,179,768, Tahiliani U.S. Pat. No. 4,487,746, and Cyarno U.S. Pat. No. 4,585,599.

SUMMARY OF THE INVENTION

Accordingly, it is an object of the present invention to provide an improved tank type liquid vacuum cleaner which completely and effectively cleans dust, debris, dirty air, and the like since these dirty materials can be forcefully mixed air with the liquid in a liquid tank.

Another object of the present invention is to provide a tank type liquid vacuum cleaner which can be used as an air cleaner when a intake hose is separated therefrom. Also the tank type liquid vacuum cleaner and air cleaner serve another function as a humidifier, respectively.

A further object of the present invention is to provide a tank type liquid vacuum cleaner which includes a ball valve in a ball valve containing tube for tightly closing an air outlet to prevent the liquid from spilling when the vacuum cleaner falls over on the floor, and an anti-overflow cylinder for preventing the liquid from overflowing.

Still another object of the present invention is to provide a tank type liquid vacuum cleaner is simple in construction, compact for portability, inexpensive to manufacture, durable in use since there is no filter therein, and refined in appearance.

Other objects and further scope of applicability of the present invention will become apparent from the detailed description given hereinafter. It should be understood, however, that the detailed description and specific examples, while indicating preferred embodiments of the invention, are given by way of illustration only, since various changes and modifications within the spirit and scope of the invention will become apparent to those skilled in the art from this detailed description.

Briefly described, the present invention relates to a tank type liquid vacuum cleaner which comprises, an intake hose, a L-shaped air inlet tube, a liquid tank, an anti-overflow cylinder in the liquid tank, a ball valve in a ball valve containing tube disposed within the anti-overflow cylinder, a vent opening, a suction fan, and a three-stage switch, whereby the vacuum cleaner effectively cleans the dust, debris, dirty air, and the like, can be easily disassembled for cleaning the internal surface of the liquid tank, and can be readily converted to an air cleaner when the intake hose is removed therefrom, and advantageously prevents the liquid in the liquid tank from spilling when the vacuum cleaner falls over on the floor.

BRIEF DESCRIPTION OF THE DRAWINGS

The present invention will become more fully understood form the detailed description given hereinbelow and the accompanying drawings which are given by way of illustration only, and thus are not limitative of the present invention, and wherein.

DESCRIPTION OF THE PREFERRED EMBODIMENTS

Figure 1:
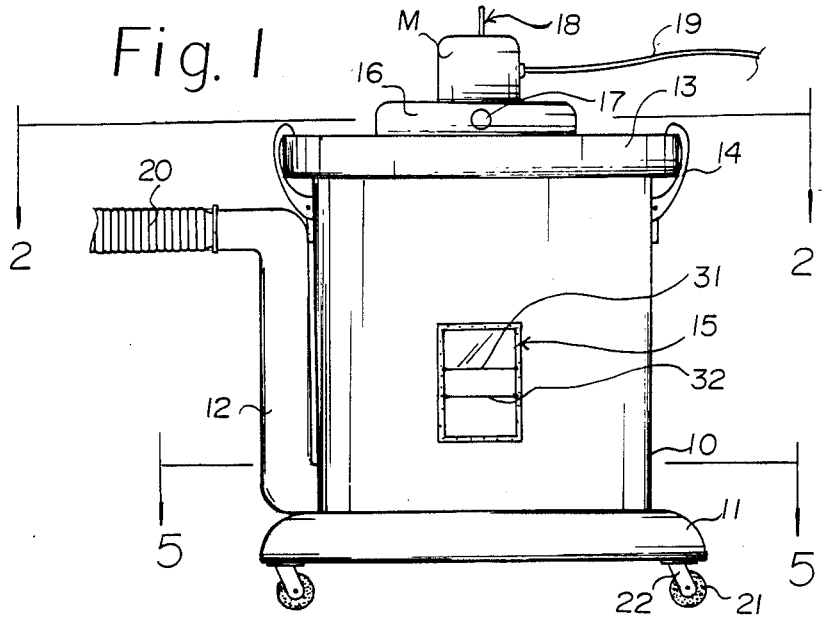
FIG. 1 is a front view of a tank type liquid vacuum cleaner according to the present invention.
Figure 2:
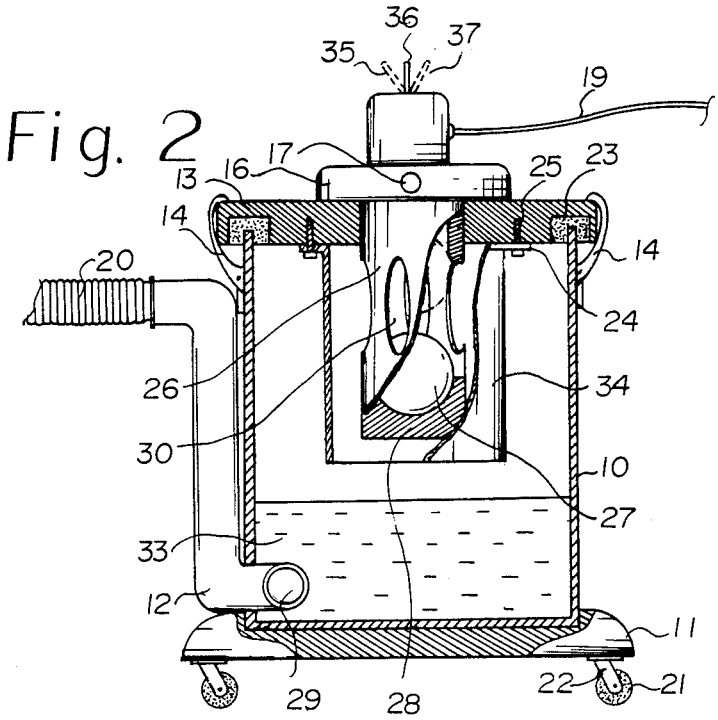
FIG. 2 is a sectional view of FIG. 1, taken along lines 2—2.

Referring now in detail to the drawings for the purpose of illustrating preferred embodiments of the present invention, the tank type liquid vacuum cleaner as shown in FIGS. 1 and 2 comprises a liquid tank 10 supported on a supporting plate 11, an air inlet tube connected to the lower portion of the liquid tank 10, a tank cover 13 covering the liquid tank 10 by the use of cover clips 14, a anti-overflow cylinder 34 suspended by the tank cover 13, a fan housing 16 supported by the tank cover 13, a vent opening 17 disposed on the fan housing 16, a motor M, and a three-stage switch 18

The liquid tank 10 contains liquid 33 such as water and the top level of the liquid 33 is disposed about one third the distance from the bottom of the liquid tank 10. Also one end of the air inlet tube 12 has an L-shaped configuration 29 inserted into the liquid 33 for forcefully mixing air with the liquid in the liquid tank 10 The other end of the air inlet tube 12 is connected to an intake hose 20 which is usually connected to a vacuum device. The liquid tank 10 includes a transparent window 15 which has an upper line 31 for indicating the need for replacement of the liquid and a lower line 32 for allowing one to maintain the liquid level (FIG. 1). The liquid tank 10 is provided with rubber packing material 23 disposed along the circumference thereof for tightly fitting the tank cover 13.

The supporting plate 11 for the liquid tank 10 is provided with a plurality of rollers 21 attached to a plurality of roller supports 22 for easily moving the portable cleaner on the floor 38. The anti-overflow cylinder 34 is attached to the tank cover 13 by bolts 25 through washers 24. A ball valve containing tube 26 is suspended by the tank cover 13 within the anti-overflow cylinder 34. The upper outlet of the ball valve containing tube 26 extends to the fan housing 16, the lower outlet of the ball valve containing tube 26 is closed with a ball valve seat 28 for seating the ball valve 27, and the middle portion of the ball valve containing tube 26 has a plurality of apertures 30 for communicating with the air in the liquid tank 10. The fan housing 16 contains a fan (not shown) for pumping the air to form a vacuum in the liquid tank 10. The motor M is connected to the three-stage switch 18 which includes an off position 36, a low power position 35 generally for using the air cleaner, and a high power position 37 generally for using the vacuum cleaner (FIG. 2). The motor M is connected to an electric wire 19 which is in turn connected to an electric source, such as an outlet.

Figure 3:
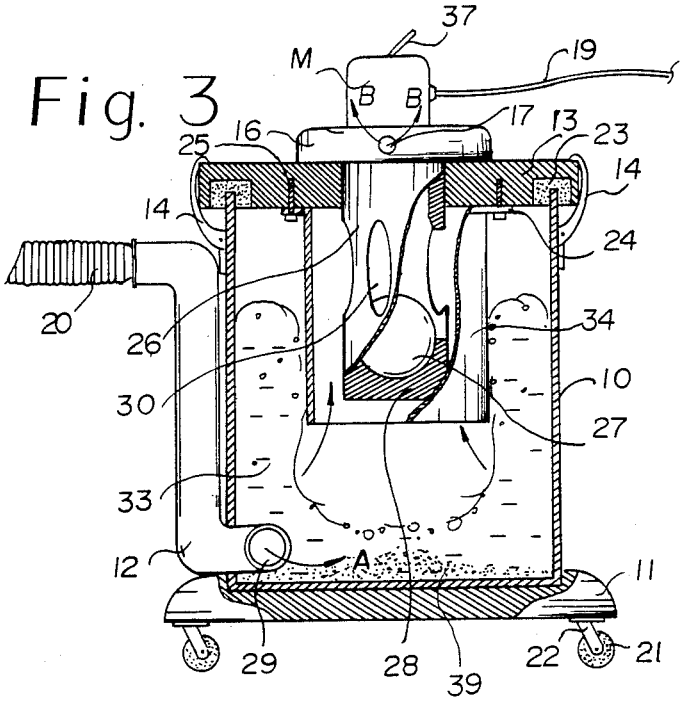
FIG. 3 is a front view of the tank type liquid vacuum cleaner according to the present invention showing in cut away portions thereof the liquid cleaning operation in the liquid tank in the operation position.
Figure 5:
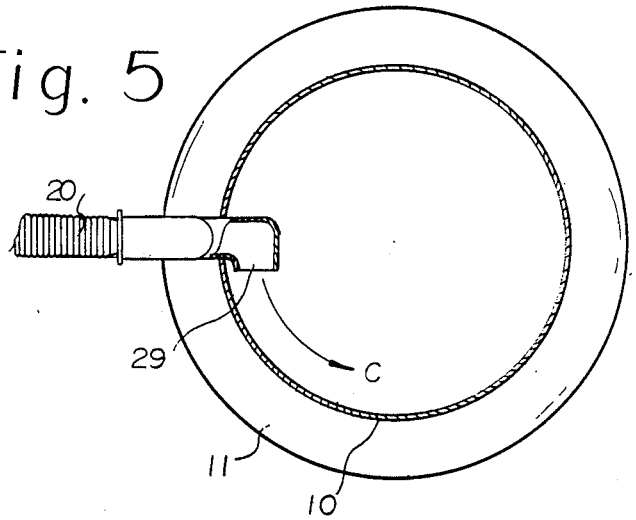
FIG. 5 is a cross-sectional view of the tank type liquid vacuum cleaner according to the present invention, taken along lines 5—5, showing the dirty air including dust and debris is rotted along the wall of the liquid tank.

According to the present invention, the tank type liquid vacuum cleaner operates as follows:

As shown in FIG. 3, when the three-stage switch 18 is actuated high power position 37, the motor M and the fan in the fan housing 16 are actuated. Therefore, since the liquid tank 10 has a vacuum formed therein, the liquid level is moved upward and simultaneously, the dirty air including dust and debris is sucked into the liquid 33 in the liquid tank in the direction indicated by arrow (A) in FIG. 3. Thereafter, the dirty air can be mixed and scrubbed with the liquid 33 such as water in the liquid tank 10 to filter and clean the dirty air. At this time, the anti-overflow cylinder 34 can prevent the liquid from overflowing from the upper outlet thereof. Thus the cleaned air is vented by the vent opening 17 in the direction indicated by arrows (B) through a plurality of apertures 30 of the ball valve containing tube 26. Since the air inlet tube 12 has an L-shaped configured end toward to the annular corner of the bottom of the liquid tank 10, the dirty air can be forcefully gyrated as in a storm in the direction indicated by arrow (C) as shown in FIG. 5.

Figure 4:
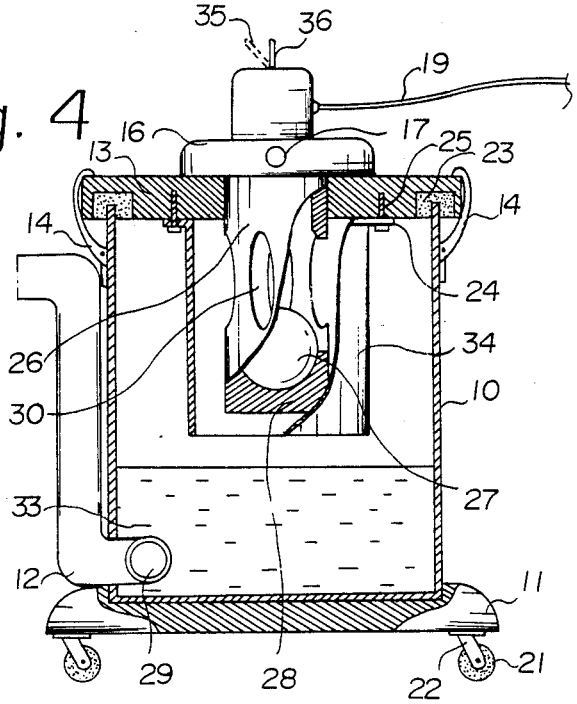
FIG. 4 is a front view of the tank type liquid vacuum cleaner according to the present invention showing in cut away portions thereof the vacuum cleaner when it is converted to an air cleaner in another embodiment of the present invention.

As shown in FIG. 4, when the intake hose 20 is separated from the vacuum cleaner of the present invention it is converted into a portable air cleaner. At this time, the three-stage switch 18 is usually actuated to the low power position 35 (FIG. 4). The operation of the air cleaner according to the present invention is the same as that of the above-described operation for the vacuum cleaner of the present invention.

Figure 6:
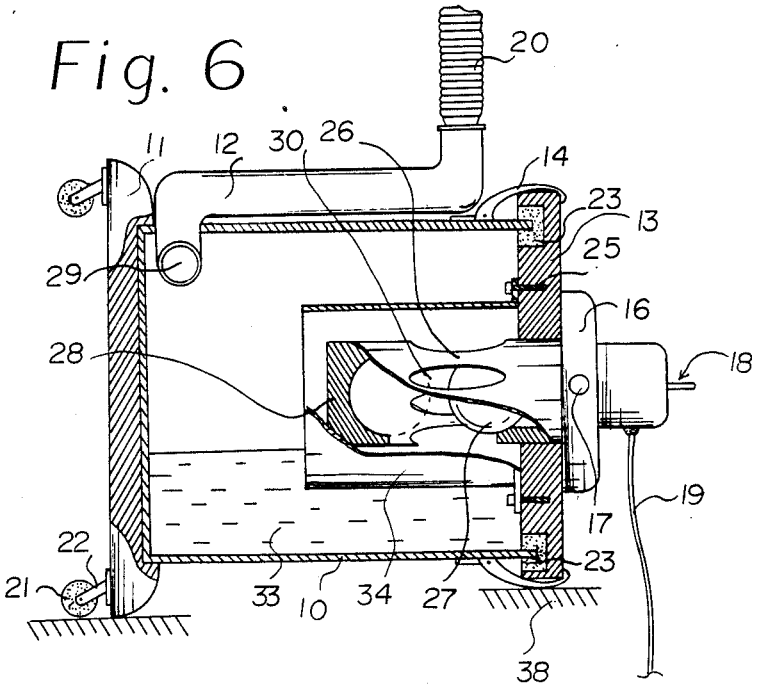
FIG. 6 is a front view of the tank type liquid vacuum cleaner according to the present invention showing in cut away portions thereof the ball valve tightly closing the air outlet when the vacuum cleaner falls over on the floor.

FIG. 6 illustrates situation when the ball valve 27 tightly closes the upper outlet of the ball valve containing tube 26 for preventing the liquid from spilling onto the floor from the vacuum cleaner.

The tank type liquid vacuum cleaner and air cleaner according to the present invention can be easily disassembled by releasing the cover clips 14 from the tank cover 13. Thereafter, the liquid containing the settled waste product 30 can be readily removed from the liquid tank (FIG. 3). And, if necessary, the liquid tank can be easily washed and cleaned in a conventional manner.

The tank type liquid vacuum cleaner and air cleaner according to the present invention serve another function as a humidifier, respectively.

The invention being thus described, it will be obvious that the same may be varied in many ways. Such variations are not to be regarded as a departure from the spirit and scope of the invention, and all such modifications as would be obvious to one skilled in the art are intended to be included in the scope of the following claims.

What is claimed is:

1. A tank type liquid vacuum cleaner which passes dirty air over a surface of a liquid which comprises:

a liquid tank containing liquid, said liquid tank being supported on a supporting plate having a plurality of rollers, an air inlet having an L-shaped end at the one end thereof for inserting into a lower portion of said liquid tank for forcefully mixing air with the liquid, said air inlet connected to an intake hose at the other end thereof, a tank cover slidably and tightly attached to said liquid tank, an anti-overflow cylinder suspended by said tank cover, a ball valve containing tube disposed within said anti-overflow cylinder, said ball valve containing tube including a plurality of apertures disposed in the middle portion thereof, a ball valve seat closed at a lower outlet for seating a ball valve on the ball valve seat, and an upper outlet thereof extending to a vent opening, a fan housing including a fan, said fan housing containing said vent opening disposed in a side wall thereof, a motor connected to an electric source for actuating said fan, and a three-stage switch connected to said motor, wherein the three-stage switch includes an off position, a low power position, and a high power position, for actuating the off-switch, and for operatively selecting a vacuum cleaner or an air cleaner, whereby the vacuum cleaner can be converted to an air cleaner to effectively clean dirty air, and prevents the liquid from spilling on the floor when the cleaner is overturned.

2. The tank type liquid vacuum cleaner of claim 1, wherein the liquid tank contains liquid filled to about one third of the distance from the bottom thereof for effectively operating the vacuum cleaner.

3. The tank type liquid vacuum cleaner of claim 1, wherein the liquid tank is provided with a transparent window attached to the middle portion thereof for indicating the level of the liquid in the liquid tank.

4. The tank type liquid vacuum cleaner of claim 3, wherein the transparent window is provided with an upper line and a lower line for indicating the level of the liquid in the liquid tank.

5. The tank type liquid vacuum cleaner of claim 1, wherein the liquid is water.

6. The tank type liquid vacuum cleaner of claim 1, wherein the tank cover is attached to the liquid tank by a plurality of cover clips pivotally connected to the upper portion of the liquid tank, said tank cover being tightly connected with rubber packing material to the circumference of the liquid tank.

7. The tank type liquid vacuum cleaner of claim 1, wherein the anti-overflow cylinder is attached to the tank cover by bolts through washers.

* * * * *